US006028618A

United States Patent [19]

Defieuw et al.

[11] Patent Number: 6,028,618

[45] Date of Patent: Feb. 22, 2000

[54] THERMAL PRINTING HEAD COATING

[75] Inventors: Geert Defieuw, Bonheiden; Raf Samijn, Wilrijk; Johan Loccufier, Zwijnaarde, all of Belgium

[73] Assignee: Agfa-Gevaert, Mortsel, Belgium

[21] Appl. No.: 09/018,740

[22] Filed: Feb. 4, 1998

Related U.S. Application Data

[60] Provisional application No. 60/041,671, Mar. 26, 1997.

[30] Foreign Application Priority Data

Feb. 22, 1997 [BE] Belgium ..... 97200518

[51] Int. Cl.[7] ..... B41J 2/335

[52] U.S. Cl. ..... 347/202

[58] Field of Search ..... 347/202, 200, 347/203

[56] References Cited

U.S. PATENT DOCUMENTS

| | | | |
|---|---|---|---|
| 5,218,381 | 6/1993 | Narang et al. | 347/45 |
| 5,485,185 | 1/1996 | Sueoka et al. | 347/64 |
| 5,759,953 | 6/1998 | Defieuw et al. | 503/210 |

FOREIGN PATENT DOCUMENTS

| | | |
|---|---|---|
| 0530929A2 | 1/1998 | European Pat. Off. . |
| WO9014958 | 12/1990 | WIPO . |

OTHER PUBLICATIONS

Proceedings of the Fifth International Congress on Advances in Non–Impact Printing Technologies, Nov. 17, 1989, San Diego, California, US, pp. 501–512, XP000138926 Nikaido et al.: "Improvement in Efficiency of Thermal Print Head".

*Primary Examiner*—N. Le
*Assistant Examiner*—Michael Nghiem
*Attorney, Agent, or Firm*—Baker & Botts, L.L.P.

[57] ABSTRACT

A thermal printing head comprising an outermost protective layer and a coating on the outermost surface of the outermost protective layer, wherein the coating comprises a hydrolyzed silane, the silane having the general formula: $SiR^1R^2R^3R^4$ wherein $R^1$, $R^2$ and $R^3$ are independently a C1 to C4 alkoxy group, a substituted C1 to C4 alkoxy group, bromine or chlorine; and $R^4$ is a C1 to C4 alkyl group; a substituted C1 to C4 alkyl group, a C1 to C4 alkoxy group or a substituted C1 to C4 alkoxy group; a coating process therefor; and a thermographic printing process utilizing said coated thermal printing head.

10 Claims, No Drawings

THERMAL PRINTING HEAD COATING

The application claims the benefit of the U.S. Provisional Application No. 60/041,671, filed Mar. 26, 1997.

DESCRIPTION

1. Field of the Invention

The present invention relates to a coating for thermal printing heads used for the image-wise heating of thermographic materials.

2. Background of the Invention

Thermal imaging or thermography is a recording process wherein images are generated by the use of image-wise modulated thermal energy. In thermography three basic approaches are known:

1. Thermal dye transfer printing wherein a visible image pattern is formed by transfer of a coloured species from an image-wise heated donor element onto a receptor element;
2. Image-wise transfer of an ingredient necessary for the chemical or physical process bringing about changes in colour or optical density to a receptor element; and
3. Direct thermal formation of a visible image pattern by image-wise heating of a recording material containing matter that by chemical or physical process changes colour or optical density.

A survey of thermographic processes is given in "Unconventional Imaging Processes" by E. Brinckman, G. Delzenne, A. Poot and J. Willems, The Focal Press—London and New York (1978), Chapter 4 under the heading "4.10 Thermography".

Thermal dye transfer printing is a recording method wherein a dye-donor element is used that is provided with a dye layer wherefrom dyed portions or incorporated dyes are transferred onto a contacting receiver element by the application of heat in a pattern normally controlled by electronic information signals. Thermal dye transfer printing materials are described, for example, in EP-B 133 012 and EP-A 133 011.

Processes in which image formation is obtained by the image-wise transfer of an ingredient necessary for the chemical or physical process bringing about changes in colour or optical density to a receptor element are, for example, described in EP-A 671 283. Materials for such processes are, for example, described in EP-A's 671 283, 671 284, 674 216, 677 775, 677 776, 678 775, 682 438, 683 428 and 706 080.

Direct thermal thermography is concerned with materials which are substantially not photosensitive, but are sensitive to heat or thermosensitive. Image-wise applied heat is sufficient to bring about a visible change in a thermosensitive imaging material. Most of the "direct" thermographic recording materials are of the chemical type. On heating to a certain conversion temperature, an irreversible chemical reaction takes place and a coloured image is produced. This irreversible reaction can be, for example, the reaction of a leucobase with an acid to produce the corresponding dye or the reduction of an organic or inorganic metal compound (e.g. silver, gold, copper or iron compounds) to its corresponding metal thereby producing a visible image. Such imaging materials are described, for example, in U.S. Pat. No. 3,080,254, EP-B 614 770, EP-B 614 769, EP-A 685 760, U.S. Pat. No. 5,527,757, EP-A 680 833, U.S. Pat. No. 5,536,696, EP-B 669 876, EP-A 692 391, U.S. Pat. No. 5,527,758, EP-A 692 733, U.S. Pat. No. 5,547,914, EP-A 730 196 and EP-A 704 318.

Image-wise heating is conventionally carried out with thermal printing heads. According to "Ullman's Encyclopedia of Industrial Chemistry", 5th completely revised edition, Vol. A13, edited by B. Elvers, S. Hawkins, M. Ravenscroft and G. Schulz, VCH Verlagsgesellschaft mbh, Weinheim, Germany (1989), pages 583–584 and S. Shibata et al., IEEE Trans. Components Hybrids Manuf. Technol. CHMT-7, 294–298 (1984), in high speed thin film thermal printing heads with a resolution of 16 dots/mm the resistive heating elements are sandwiched between a heat-insulating layer and a highly thermally conductive acid-resistant protective layer such as SiC, $Ta_2O_5$, $SiO_2$, $Al_2O_3$ or $Si_3N_4$. According to JP-A 55-84683 and JP-A 57-89980 it is conventional practice to coat these high thermal conductivity protective layers with an abrasion-resistant layer by sputtering or evaporating a substance having a high hardness and high thermal conductivity and according to Shibata et al. SiC, $Al_2O_3$, $SiO_2$, $Si_3N_4$, $Ta_2O_5$ or $TiO_2$ are suitable for this purpose. Head temperatures can vary from 250 to 550° C. depending on the duration of the heating and the heating power applied thereto.

The requirement of constant print quality at high image resolution over the whole material width coupled with an acceptable lifetime for the thermal printing head in contact with different thermographic imaging materials places considerable demands upon the thermal printing head. Thin film thermal printing heads which are used with less thermally sensitive imaging materials are more susceptible to failure due to the higher printing head temperatures necessary for printing. Furthermore this susceptibility to failure increases with the applied heating power and hence with the temperature attained during the heating process. Thermal printing head failure can be due to physical abrasion and/or chemical erosion and chemical interaction between the protective layer of the thermal printing head and the ingredients of the imaging materials at the elevated temperatures at which image formation takes place.

Physical abrasion of thermal printing heads can be reduced by incorporating lubricants into the imaging materials which come into contact with the thermal printing head as disclosed for example in EP-A 669 876.

U.S. Pat. No. 4,396,684 discloses that reduction in the concentration of sodium and potassium ions in thermographic recording paper to less than 601ppm results in reduced abrasion of thermal printing heads in contact therewith. O. P. Srivastava at the 3rd Annual Printing Workshop held at Cambridge, Mass., USA between 23 and 25 Mar. 1992 suggested that sodium and/or potassium ions in thermographic materials form their hydroxides with water present in the atmosphere during thermal printing and these hydroxides dissolve the protective glass coating of thermal printing heads and then migrate into the resistor material accelerating heating element failure.

The presence of sodium, potassium and chloride ions in thermographic materials in direct contact with the thermal printing head during image-wise printing has an adverse effect on the operating lifetime of thermal printing heads which becomes more severe as the temperature at which printing is carried out is increased. For high printing temperatures a means of limiting or preventing the diffusion of these ions to the thermal printing head is therefore required. Furthermore, it is desirable for ecological reasons to coat thermographic materials from aqueous solutions or dispersions and it is extremely difficult to exclude these ions from water, hydrophilic dispersion agents and hydrophilic ingredients in general to attain a concentration of sodium and potassium ions below the 601ppm stipulated in U.S. Pat. No. 4,396,684.

In the commercial production of thin film thermal printing heads it is impossible to avoid the occurrence of microscopically detectable thickness variation in the protective layer so-called pinholes or spots. These pinholes or spots are typically 3 to 10 $\mu$m deep and 5 to 50 $\mu$m in diameter.

The failure of individual heating elements in thermal printing heads in the absence of substantial abrasion of the protective layer of the thermal printing head may be due to chemical interaction between the heating elements of the thermal printing head and ions or molecules from the imaging materials which have diffused through the thinner protective coating to or have reacted directly with the heating elements exposed at the bottom of pinholes.

In order to extend the operating lifetime of thermal printing heads used for the image-wise heating of thermographic recording materials, it is therefore necessary to prevent diffusion of ions and molecules from the thermographic recording materials to the heating elements in general and through the pinholes in the protective layer in particular.

OBJECT OF THE INVENTION

It is therefore an object of the invention to provide a process for extending the lifetime of thermal printing heads used for the image-wise heating of substantially non-photosensitive thermographic recording materials without adversely affecting their printing characteristics.

Further objects and advantages of the invention will become apparent from the description hereinafter.

SUMMARY OF THE INVENTION

The above mentioned object is realised by a thermal printing head comprising an outermost protective layer and a coating on the outermost surface of the outermost protective layer, wherein the coating comprises a hydrolyzed silane, the silane having the general formula: $SiR^1R^2R^3R^4$ wherein $R^1$, $R^2$ and $R^3$ are independently a C1 to C4 alkoxy group, a substituted C1 to C4 alkoxy group, bromine or chlorine; and $R^4$ is a C1 to C4 alkyl group; a substituted C1 to C4 alkyl group, a C1 to C4 alkoxy group or a substituted C1 to C4 alkoxy group.

A process for coating a thermal printing head is also provided, the thermal printing head comprising a linear array of resistor elements with a heat-resistant support on one side of the resistor elements and at least one protective layer on the other side thereof, comprising the steps of: (i) applying a coating to the outermost surface of the outermost protective layer of the thermal printing head; (ii) heating the coating; and (iii) removing poorly adhering parts of the coating from the outermost surface of the thermal printing head by cleaning or printing, wherein the coating is applied as a solution or dispersion comprising water and a silane having the above-mentioned general formula.

A thermographic printing process is further provided comprising the steps of: (i) bringing a substantially non-photosensitive thermographic recording material into thermal contact with a thermal printing head having the coating described above; (ii) image-wise heating the thermographic recording material with the thermal printing head; and (iii) separating the thermographic recording material from the thermal printing head.

Further preferred embodiments of the present invention are disclosed in the dependent claims.

DETAILED DESCRIPTION OF THE INVENTION

Process for Coating a Thermal Printing Head

According to the present invention the outermost surface of the outermost protective layer, preferably silicon nitride, of a thermal printing head is coated with a coating comprising water and a silane having the general formula: $SiR^1R^2R^3R^4$ wherein $R^1$, $R^2$ and $R^3$ are independently a C1 to C4 alkoxy group, bromine or chlorine; and $R^4$ is a C1 to C4 alkyl group, a substituted C1 to C4 alkyl group, a C1 to C4 alkoxy group, bromine or chlorine. The substituted C1 to C4 alkyl groups may be substituted with any substituents including, for example, the following groups: acryloyloxy, methacryloyloxy, amino, substituted amino, carboxyl, carboxyester, acyl, epoxy, glycidyloxy, epoxyoxy, oxoamine, nitrile, vinyl, substituted vinyl, hydroxy, thiol, thiooxoalkyl, thiooxoaryl, fluoroalkyl etc. Particularly preferred silanes according to the present invention are selected from the group consisting of γ-glycidyloxypropyltrimethoxysilane, methacryloyloxypropyltrimethoxy-silane, tetramethylorthosilicate and tetraethylorthosilicate. The silanes of the present invention may be on their own or in admixture with one of more other silanes. The use of a mixture of γ-glycidyloxypropyltrimethoxysilane and tetraethylorthosilicate or a mixture of methacryloyloxypropyltrimethoxysilane and tetraethylorthosilicate in the coating composition is particularly preferred.

The coating may further comprise curable silicone compounds, which when used on their own to coat the protective layers of thermal printing heads produce coatings which are too soft to withstand the abrasive effect of printing thermographic recording materials; a catalyst to promote the hydrolysis of the silanes of the present invention such as an acid, e.g. hydrochloric acid, methanesulfonic acid or formic acid, a basic catalyst, e.g. an alcoholate of titanium, zirconium or aluminium, imidazole etc.; colloidal inorganic particles, such as oxides, hydrated oxides, nitrides and carbides of silicon, boron, aluminium and transition metals such as zinc, titanium and zirconium with a specific surface area of preferably at least 100 $m^2/g$, for example, silica, aluminium oxide, zinc oxide, bentonite, boehmite and the like; an aromatic polyol with a molecular weight less than or equal to 1000, such as bisphenol A, bisphenol F, bisphenol S and 1,5-dihydroxynaphthalene, vinyl or substituted vinyl monomers such as methyl methacrylate, binders, such as polyvinyl alcohol which react with the hydrolysed silane, inorganic compounds, such as metal nitrates, metal chlorides etc., organometallic compounds, such as metal acetates, metal formates, metal alkoxides etc., metal chelates, such as metal acetylacetonates, organic compounds, such as amines, tensides which may be cationic, anionic or non-ionic and additives which improve the frictional properties of the resulting coating, such as particles of clay, talc etc, particularly china clay, and other well known thermally stable lubricants.

The dispersion medium or solvent can be deionized water, one or more organic solvents or a mixture of water and one or more organic solvents. Examples of suitable organic solvents are methanol, ethanol, n-propanol, isopropanol, butanol, sec-butanol, tert-butanol, methanone, 2-butanone etc.

Curing of the coating is usually performed thermally, but radiation curing may also be carried out with appropriate ingredients, for example silanes comprising substituted vinyl groups.

Upon contact with water the silanes hydrolyze and the viscosity of the solution or dispersion begins to increase. Coating may be carried out before significant viscosity increase has taken place or when the viscosity of the solution or dispersion has increased by prepolymerization to the required coating viscosity. The coating may at the end of the coating process, i.e. after any cleaning step, cover the outermost surface of the outermost protective layers of the thermal printing head or only a part thereof, but must at least fill any pinholes present in the outermost surface. The process for coating a thermal printing head of the present invention may be carried out as many times as is necessary to achieve the objects of the present invention, the coating thickness resulting from each process cycle preferably not exceeding 1 μm. Substantially non-photosensitive thermographic recording material According to the present invention, a substantially non-photosensitive thermographic recording material comprises a material or set of materials necessary for image formation.

In one embodiment thereof the substantially non-photosensitive thermographic recording material comprises a donor ribbon comprising a sublimable dye layer and a receiving layer for the sublimable dye.

In another embodiment thereof it comprises a donor ribbon and a receiving layer, the donor ribbon comprising a component which under the influence of heat is transferred to the receiving layer and undergoes a colour-forming reaction with a component thereof. For example the donor ribbon might contain a toning agent and/or one or more reducing agents and the receiving layer might contain a reducible silver source.

In a still further embodiment thereof it is a substantially non-photosensitive thermographic recording material comprising a support and at least one thermosensitive element.

Thermosensitive Element

The thermosensitive element, according to the present invention which under the influence of imagewise heating forms an image either in the element itself or after peeling off a material delaminated during the image-wise heating. The element may comprise a layer system and any active ingredients may be present in different layers although in thermal working relationship with one another during the thermal development process.

Such thermosensitive elements may, for example, comprise leuco dyes with acid-releasing ingredients, substantially light-insensitive reducible silver sources and reducing agents therefor in thermal working relationship therewith or delaminatable pigment layers. In a particular embodiment of the present invention the element comprises a substantially light-insensitive reducible silver source, a reducing agent therefor in thermal working relationship therewith and a binder.

Reducible Silver Sources

Preferred substantially light-insensitive reducible silver sources according to the present invention are organic silver salts. Preferred organic silver salts, according to the present invention, are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, with silver behenate being particularly preferred. Such silver salts are also called "silver soaps". In addition silver dodecyl sulphonate described in U.S. Pat. No. 4,504,575; and silver di-(2-ethylhexyl)-sulfosuccinate described in EP-A 227 141, modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677.

Reducing Agents

Suitable organic reducing agents for the reduction of the substantially light-insensitive organic heavy metal salts are organic compounds containing at least one active hydrogen atom linked to O, N or C, such as is the case with, aromatic di- and tri-hydroxy compounds; aminophenols; METOL (tradename); p-phenylenediamines; alkoxynaphthols, e.g. 4-methoxy-1-naphthol described in U.S. Pat. No. 3,094,41; pyrazolidin-3-one type reducing agents, e.g. PHENIDONE (tradename); pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

Among useful aromatic di- and tri-hydroxy compounds having at least two hydroxy groups in ortho- or para-position on the same aromatic nucleus, e.g. benzene nucleus, hydroquinone and substituted hydroquinones, catechol, pyrogallol, gallic acid and gallic acid esters are preferred. Particularly preferred catechol-type reducing agents are disclosed in EP-A 692 733, e.g. 3,4-dihydroxybenzoic acid esters such as ethyl and butyl 3,4-dihydroxybenzoate.

Auxiliary Reducing Agents

The above mentioned reducing agents being considered as primary or main reducing agents may be used in conjunction with so-called auxiliary reducing agents. Such auxiliary reducing agents are e.g. sterically hindered phenols, that on heating become reactive partners in the reduction of the substantially light-insensitive organic heavy metal salt such as silver behenate, such as described in U.S. Pat. No. 4,001,026; are bisphenols, e.g. of the type described in U.S. Pat. No. 3,547,648; or are sulfonamidophenols. The auxiliary reducing agents may be present in the imaging layer or in a polymeric binder layer in thermal working relationship thereto.

Film-forming Binders of the Thermosensitive Element

The film-forming binder of the thermosensitive element containing the substantially light-insensitive reducible silver source may be all kinds of natural, modified natural or synthetic resins or mixtures of such resins, wherein the organic heavy metal salt can be dispersed homogeneously: e.g. cellulose derivatives such as ethylcellulose, cellulose esters, e.g. cellulose nitrate, carboxymethylcellulose, starch ethers, galactomannan, polymers derived from α, β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic heavy metal salt, at a temperature above 60° C.

Toning Agents

In order to obtain a neutral black image tone in the higher densities and neutral grey in the lower densities the recording layer contains preferably in admixture with the organic silver salts and reducing agents a so-called toning agent known from thermography or photothermography.

Suitable toning agents are the phthalimides and phthalazinones within the scope of the general formulae described in U.S. Pat. No. 4,082,901. Further reference is made to the toning agents described in U.S. Pat. Nos. 3,074,809, 3,446,648 and 3,844,797. Other particularly useful toning agents are the heterocyclic toner compounds of the benzoxazine dione or naphthoxazine dione type described in GB-P 1,439,478 and U.S. Pat. No. 3,951,660.

A toner compound particularly suited for use in combination with polyhydroxy benzene reducing agents is 3,4-dihydro-2,4-dioxo-1,3,2H-benzoxazine described in U.S. Pat. No. 3,951,660.

Other Ingredients

The recording layer may contain in addition to the ingredients mentioned above other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, e.g. BAYSILONE Öl A (tradename of BAYER AG—GERMANY), ultraviolet light absorbing compounds, white light reflecting and/or ultraviolet radiation reflecting pigments, silica, and/or optical brightening agents.

Support

The support for the thermal imaging material according to the present invention may be transparent, translucent or opaque, e.g. having a white light reflecting aspect and is preferably a thin transparent resin film, e.g. polyethylene terephthalate.

The support may be in sheet, ribbon or web form and subbed if need be to improve the adherence to the thereon coated thermosensitive recording layer. The support may be made of an opacified resin composition. Should a transparent base be used, the base may be colourless or coloured, e.g. have a blue colour. Outermost layer in contact with the thermal printing head assembly The outermost layer of the substantially non-photosensitive thermographic recording material on the same side of the support as the thermosensitive element, according to the present invention, may be a protective layer applied to the thermosensitive element to avoid local deformation of the thermosensitive element and to improve resistance against abrasion or the outermost layer of the thermosensitive element. Such protective layers may also comprise particulate material, e.g. talc particles, optionally protruding from the protective outermost layer as described in WO 94/11198. Other additives can also be incorporated in the protective layer e.g. colloidal particles such as colloidal silica.

A maximum dynamic frictional coefficient between the thermal printing head assembly and the outermost layer in contact with the thermal printing head assembly of less than 0.3 can be attained by one skilled in the art by a combination of one or more matting agents, as described in WO 94/11198 with one or more thermomeltable particles optionally with one or more lubricants, as described in WO 94/11199, or with at least one solid lubricant having a melting point below 150° C. and at least one liquid lubricant in a binder, wherein at least one of the lubricants is a phosphoric acid derivative.

Binder for Outermost Layer of the Thermographic Material

According to an embodiment of the present invention the outermost layer of the recording material on the same side of the support as the thermosensitive element comprises a water-dispersible, a water-soluble or a water-soluble and a water-dispersible binder. Suitable water-soluble binders for the outermost layer in contact with the thermal printing head assembly are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred. Suitable water-dispersible binders are, for example, polymer lattexes.

Crosslinking Agents for Outermost Layer

According to an embodiment of the present invention the outermost layer of the recording material in contact with the thermal printing head assembly may be crosslinked. Crosslinking can be achieved by using crosslinking agents such as described in WO 95/12495 for protective layers, e.g. tetra-alkoxysilanes, polyisocyanates, zirconates, titanates, melamine resins etc., with tetraalkoxysilanes such as tetramethylorthosilicate and tetraethylorthosilicate being preferred.

Matting Agents for Outermost Layer

The outermost layer of the recording material in contact with the thermal printing head assembly according to the present invention may comprise a matting agent. Suitable matting agents are described in WO 94/11198 and include e.g. talc particles and optionally protrude from the outermost layer.

Lubricants for Outermost Layer

The outermost layer of the recording material according to the present invention may comprise at least one lubricant. Examples of suitable lubricating materials are surface active agents, liquid lubricants, solid lubricants which do not melt during thermal development of the recording material, solid lubricants which melt (thermomeltable) during thermal development of the recording material or mixtures thereof.

The lubricant is preferably selected from a group consisting of silicon derivatives, polyolefins, fatty acid derivatives, fatty alcohol derivatives and phosphoric acid derivatives.

Antistatic Layer

The thermographic recording material comprising a support and a thermosensitive element, of the present invention, may further comprise an outermost antistatic layer on the opposite side of the support to the thermosensitive element. Suitable antistatic layers therefor are described, for example, in U.S. Pat. No. 5,354,613.

Coating

The coating of any layer of the recording material of the present invention may proceed by any coating technique e.g.

such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Processing Assemblies

As described in "Handbook of Imaging Materials", edited by Arthur S. Diamond—Diamond Research Corporation—Ventura, Calif., printed by Marcel Dekker, Inc. 270 Madison Avenue, New York, N.Y. 10016 (1991), p. 498–502 in thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. The operating temperature of common thermal printheads is in the range of 300 to 400° C. and the heating time per picture element (pixel) may be 50 ms or less, the pressure contact of the thermal printhead with the recording material being e.g. 100–500 g/cm of linear array of resistor elements to ensure a good transfer of heat.

In a preferred embodiment of the thermographic printing process, according to the present invention, a pressure of at least 100 g per cm of linear array of resistor elements is applied between the substantially non-photosensitive thermographic recording material and the thermal printing head assembly.

In a particular embodiment of the method according to the present invention the thermographic image-wise heating of the recording material proceeds by Joule effect heating in that selectively energized electrical resistors of a thermal printing head array are used in contact or close proximity with the recording layer.

The image signals for modulating the current in the micro-resistors of a thermal printhead are obtained directly or from an intermediary storage means, optionally linked to a digital image work station wherein the image information can be processed to satisfy particular needs. Activation of the heating elements can be power-modulated or pulse-length modulated at constant power.

According to EP-A 622 217 relating to a method for making an image using a direct thermal imaging element, wherein the activation of the heating elements is executed line by line with a duty cycle Δ representing the ratio of activation time to total line time in such a way that the following equation is satisfied:

$$P \leq P_{max} = 3.3\ W/mm^2 + (9.5\ W/mm^2 \times \Delta)$$

wherein $P_{max}$ is the maximal value over all the heating elements of the time averaged power density P (expressed in $W/mm^2$) dissipated by a heating element during a line time.

Thermographic imaging can be used for both the production of transparencies and reflection type prints. In the hard copy field recording materials on a white opaque base are used. Black-imaged transparencies with transparent bases are used in both the graphics and medical diagnostic fields. In the graphics field dots and lines are printed using thermographic recording materials with a hard gradation and the transparencies are used as masks in the exposure of photosensitive compositions on printing plate bases in the process of printing plate preparation. In the medical diagnostic field black-imaged transparencies are widely used in inspection techniques operating with a light box.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appending claims.

PREPARATION OF A SUBSTANTIALLY NON-PHOTOSENSITIVE THERMOGRAPHIC RECORDING MATERIAL FOR TESTING THERMAL PRINTING HEADS TREATED ACCORDING TO THE PRESENT INVENTION

Thermosensitive Element

A subbed polyethylene terephthalate support having a thickness of 175 μm was doctor blade-coated with a coating composition containing 2-butanone as a solvent and the following ingredients so as to obtain thereon, after drying for 1 hour at 50° C., a layer containing:

silver behenate: 4. 91g/$m^2$ polyvinylbutyral (Butvar™ B79 from Monsanto): 19.62 g/$m^2$ silicone oil (Baysilonem™ MA from Bayer AG): 0.045 g/$m^2$ benzo [e] [1,3] oxazine-2,4-dione, a toning agent: 0.268 g/$m^2$ 7-(ethylcarbonato)-benzo [e] [1,3] oxazine-2,4-dione dione, a toning agent (see formula II below): 0.138 g/$m^2$ butyl-3,4-dihydroxybenzoate, a reducing agent: 1.003 g/$m^2$ tetrachlorophthalic anhydride: 0.157 g/$m^2$ adipic acid: 0.352 g/$m^2$ benzotriazole 0.130 g/$m^2$

II)

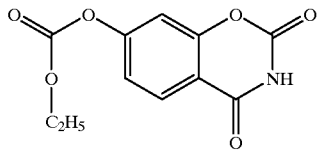

Coating of the Thermosensitive Element with a Protective Layer

The thermosensitive element was then coated with an aqueous composition with the following composition expressed as weight percentages of ingredients present:

polyvinylalcohol (Mowiviol™ WX 48 20 from Wacker Chemie): 2.5%

Ultravon™ W (dispersion agent from Ciba Geigy) converted into acid form by passing through an ion exchange column: 0.09% talc (type P3 from Nippon Talc): 0.05% colloidal silica (Levasil™ VP AC 4055 from Bayer AG, a 15% aqueous dispersion of colloidal silica): 1.2% silica (Syloid™ 72 from Grace): 0.10% mono [isotridecyl polyglycolether (3 EO)] phosphate (Servoxyl™ VPDZ 3/100 from Servo Delden B.V.): 0.09% mixture of monolauryl and dilauryl phosphate (Servoxyl™ VPAZ 100 from Servo Delden B.V.): 0.09% glycerine monotallow acid ester (Rilanit™ GMS from Henkel AG): 0.18% tetramethylorthosilicate hydrolyzed in the presence of methanesulfonic acid: 2.1%

The pH of the coating composition was adjusted to a pH of 3.8 by adding 1N nitric acid. Those lubricants in these compositions which were insoluble in water, were dispersed in a ball mill with, if necessary, the aid of a dispersion agent. The compositions were coated to a wet layer thickness of 85 μm and were then dried at 40° C. for 15 minutes and hardened at 45° C. for 7 days.

COMPARATIVE EXAMPLE 1

A printing run was carried out with sheets of the above-described substantially non-photosensitive thermographic recording material in an experimental printer equipped with a thin film thermal printing head with a pinhole in its outermost protective layer.

Printing was carried out with a printer in which the above-mentioned thin film thermal printing head had been installed in which the sheets of substantially non-photosensitive thermographic material were fed at a speed of 4 mm/s onto a drum past the thermal printing head mounted in such a way as to contact the substantially non-photosensitive thermographic material. The thermal printing head was operated at a line time of 19 ms (the line time being the time needed for printing one line), during which it received constant power, and at an average printing power, being the total amount of electrical energy used for printing one line divided by the line time and the surface area of the heat-generating resistors, of 1.25 mJ/dot, being sufficient to obtain maximum density in said recording material.

A defective heating element, corresponding in position to the pinhole in the outermost protective layer of the thermal printing head was detected in the prints as a white line after 50 prints.

INVENTION EXAMPLE 1

A mixture of 14.5 g of a copolymer consisting of 80 mol % of methyl methacrylate and 20 mol % of methacryloyloxypropyltrimethoxysilane, 2.5 g of tetraethylorthosilicate, 5 g of glycidyloxypropyltrimethoxysilane (GPTS), 15 ml of 2-butanone and 0.5 g of deionized water was stirred for 1 hour at 25° C. to produce dispersion A.

Dispersion A was then applied from a pipette via an injection needle to the outermost protective layer of the same type of thin film thermal printing head as used in COMPARATIVE EXAMPLE 1 to fill the pinholes therein. The excess of dispersion A was removed from the thermal printing head either by applying a current to the heating elements thereof for about 7 minutes, removing the excess dispersion with a cloth moistened with 2-butanone and then heating the thermal printing head for 40 minutes at 130° C.

Performance of Coating During Printing

A printing run of 1000 prints was carried out with a thermal printing head with a pinhole using sheets of the above-described substantially non-photosensitive thermographic material as described for COMPARATIVE EXAMPLE 1. Evaluation of the thermal printing head with a microscope afterwards showed that the pinholes in the protective layer had remained filled with the coating and that no discolouration of the heating elements in the thermal printing head had taken place. Furthermore none of the heating elements of the thermal printing head was defective after this printing run of 1000 prints, which shows that application of a coating, according to the present invention, to the protective layer of a thermal printing head with a pinhole has prevented the premature failure of the heating elements observed with a thermal printing head with a pinhole which had not been subjected to the above-described treatment, see COMPARATIVE EXAMPLE 1.

INVENTION EXAMPLE 2

A mixture of 75 g of a 21.7% by weight solution a copolymer consisting of 80 mol % of methyl methacrylate and 20 mol % of methacryloyloxypropyltrimethoxysilane in 2-butanone, 6.7 g of tetraethylorthosilicate, 1 g of formic acid and lg of deionized water was stirred for 1 hour at 25° C. to produce dispersion B.

Dispersion B was then applied from a pipette via an injection needle to the outermost protective layer of the same type of thin film thermal printing head as used in COMPARATIVE EXAMPLE 1 to fill the pinholes therein. The excess of dispersion B was removed from the thermal printing head either by applying a current to the heating elements thereof for about 7 minutes, removing the excess dispersion with a cloth moistened with 2-butanone and then heating the thermal printing head for 40 minutes at 130° C.

In a preliminary evaluation 30 prints were made as described in COMPARATIVE EXAMPLE 1. Evaluation of the thermal printing heads with a microscope afterwards showed that the pinholes in the protective layer had remained filled with the coating.

INVENTION EXAMPLE 3

A mixture of 25 g of tetraethylorthosilicate and 250 g of 2-butanone was prehydrolysed with the following quantities of deionized water and catalyst by stirring for 4 hours at 25° C. to produce dispersions C, D and E:

dispersion C: with 2.16 g of $H_2O$ and 0.576 g of methanesulfonic acid dispersion D: with 2.16 g of $H_2O$ and 0.408 g of imidazole dispersion E: with 3.88 g of $H_2O$ and 0.408 g of imidazole Dispersions C, D and E were then each applied from a pipette via an injection needle to the outermost protective layer of different thin film thermal printing heads each with a pinhole in its outermost protective layer to fill the pinholes therein. The thermal printing heads were then heated for 15 minutes at 65° C. and the excess of the dispersions removed by applying a cloth moistened with a mixture of 2-butanone and isooctane.

In a preliminary evaluation 5 prints were made as described in COMPARATIVE EXAMPLE 1. Evaluation of the thermal printing heads with a microscope afterwards showed that the pinholes in the protective layer had remained filled with the coating.

Having described in detail preferred embodiments of the current invention, it will now be apparent to those skilled in the art that numerous modifications can be made therein without departing from the scope of the invention as defined in the following claims.

We claim:

1. A thermal printing head comprising an outermost protective layer having an outermost surface for contacting a printing medium and a protective coating on said outermost surface of said outermost protective layer, wherein said protective coating comprises a hydrolyzed silane, said silane having the general formula: $SiR^1R^2R^3R^4$ wherein $R^1$, $R^2$ and $R^3$ are independently a C1 to C4 alkoxy group, a substituted C1 to C4 alkoxy group, bromine, or chlorine; and $R^4$ is a C1 to C4 alkyl group; a substituted C1 to C4 alkyl group, a C1 to C4 alkoxy group or a substituted C1 to C4 alkoxy group.

2. Thermal printing head according to claim 1, wherein said silane is selected from the group consisting of γ-glycidyloxypropyltrimethoxysilane, methacryloyloxypropyltrimethoxysilane, tetramethyl orthosilicate and tetraethylorthosilicate.

3. Thermal printing head according to claim 1, wherein said coating further comprises colloidal inorganic particles with a specific surface area of at least 100 $m^2/g$.

4. Thermal printing head according to claim 1, wherein said outermost protective layer comprises silicon nitride.

5. A process for coating a thermal printing head, said thermal printing head comprising a linear array of resistor elements with a heat-resistant support on one side of said resistor elements and at least one protective layer on the other side thereof, comprising the steps of: (i) applying a coating to an outermost surface of an outermost protective layer for contact with a printing medium of the said thermal print head; (ii) heating said coating; and (iii) removing poorly adhering parts of said coating from said outermost surface of the thermal printing head by cleaning or printing, wherein said coating is applied as a solution or dispersion comprising water and a silane having the general formula: $SiR^1R^2R^3R^4$ wherein $R^1$, $R^2$ and $R^3$ are independently a C1 to C4 alkoxy group, a substituted C1 to C4 alkoxy group, a C1 to C4 alkoxy group or a substituted C1 to C4 alkoxy group.

6. Process for coating a thermal printing head according to claim 5, wherein said solution or dispersion comprises methacryloyloxypropyltrimethoxysilane and tetraethylorthosilicate.

7. Process for coating a thermal printing head according to claim 5, wherein said coating further comprises colloidal inorganic particles with a specific surface area of at least 100 $m^2/g$.

8. A thermographic printing process comprising the steps of: (i) bringing a non-photosensitive thernographic recording material into thermal contact with a thermal printing head; (ii) image-wise heating said thermographic recording material with said thermal printing head; and (iii) separating said thermographic recording material from said thermal printing head, wherein said thermal printing head is provided with a protective coating comprising a hydrolyzed silane, said silane having the general formula: $SiR^1R^2R^3R^4$ wherein $R^1$, $R^2$ and $R^3$ are independently a C1 to C4 alkoxy group; a substituted C1 to C4 alkoxy group, bromine or chlorine; and $R^4$ is a C1 to C4 alkyl group; a substituted C1 to C4 alkyl group, a C1 to C4 alkoxy group or a substituted C1 to C4 alkoxy group.

9. Thermographic printing process according to claim 8, wherein said non-photosensitive thermographic recording material comprises a support and a thermosensitive element, said thermosensitive element comprising a substantially light-insensitive organic silver salt, a reducing agent therefor in thermal working relationship therewith and a binder.

10. Thermographic printing process according to claim 9, wherein the outermost layer of said recording material on the same side of the support as said thermosensitive element comprises a water-dispersible, a water-soluble or a water-soluble and a water-dispersible binder.

* * * * *